United States Patent [19]

Howard

[11] 4,253,080

[45] Feb. 24, 1981

[54] FUSE WITH HELICAL FUSE ELEMENT

[75] Inventor: John F. Howard, Peterborough, Canada

[73] Assignee: Canadian General Electric Co. Ltd., Toronto, Canada

[21] Appl. No.: 917,822

[22] Filed: Jun. 21, 1978

[30] Foreign Application Priority Data

Aug. 19, 1977 [CA] Canada ..... 285129

[51] Int. Cl.[3] ..... H01H 85/04

[52] U.S. Cl. ..... 337/159; 337/252; 337/290

[58] Field of Search ..... 337/158, 159, 186, 295, 337/290, 187, 252

[56] References Cited

U.S. PATENT DOCUMENTS 4,001,748 1/1977 Salzer ..... 337/252

4,020,441 4/1977 Jacobs, Jr. ..... 337/159

4,117,441 9/1978 Wycklendt ..... 337/295

FOREIGN PATENT DOCUMENTS 1124137 2/1962 Fed. Rep. of Germany ..... 337/295

*Primary Examiner*—George Harris

*Attorney, Agent, or Firm*—William Freedman; John P. McMahon

[57] ABSTRACT

A current limiting fuse has a helically coiled fuse element of ribbon-like material extending within a tubular casing between metallic end caps. The ribbon-like material is edge on to the axis of the helix for permitting a greater length of fuse element than if the ribbon-like material had its flat side towards the axis. In a preferred form, the ribbon-like material has ripples or indentations across it with the ripples having a greater displacement at the edge of the ribbon-like fuse element nearer the axis.

4 Claims, 6 Drawing Figures

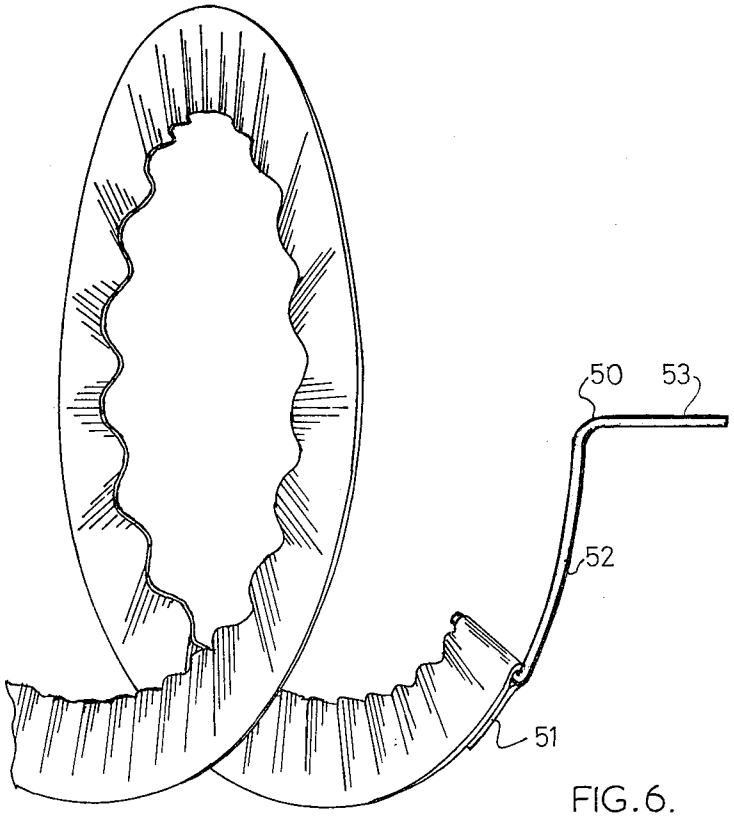
FIG. 6.
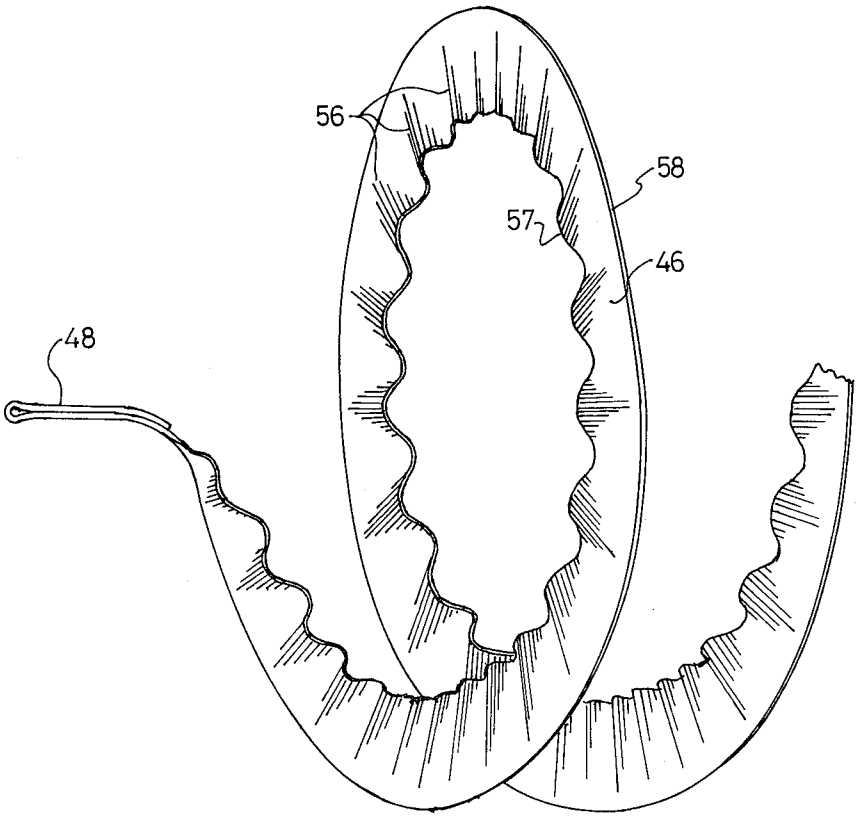

FUSE WITH HELICAL FUSE ELEMENT

BACKGROUND OF THE INVENTION

This invention relates to high voltage fuses, and in particular it relates to high voltage fuses of the current limiting type.

High voltage, current limiting fuses normally comprise a fusible element, or more simply a fuse element, totally enclosed in a tubular casing or cartridge with a pulverulent arc quenching material filling the casing and in contact with the fuse element. Fuses of this type which are intended for higher voltages and large current limiting capacities requires (a) a long fuse element to provide for many small arcs to develop along the length thereof under fault conditions, and (b) a fuse element with a large surface area to provide increased contact with the arc quenching material. In order to have a long fuse element without unduly increasing the length of the casing, the fuse element is usually in the form of a helix. The fuse element is commonly wound on a central supporting core of ceramic or other insulating material to form a helix. In order to have a fuse element with a large surface area, a flat ribbon-like configuration for the fuse element is usually preferred to a wire-like configuration. The ribbon is wound flat on the core. It will be apparent that, for the same spacing between turns of a helix, and the same size of supporting core, a flat ribbon will require a longer casing to contain it than an equivalent wire fuse element and this may compromise the fuse design.

In some applications, for example in a current limiting fuse section of a combination fuse for use in the protection of capacitors in a power system capacitor bank, a fuse element having a length of the order of six feet might be desired. Such a fuse is required to carry high transient currents and to control fault currents. This capability is improved by large surface contact between the fuse element and the surrounding arc quenching material. In the past, it has been difficult to design and produce a current limiting fuse which has a long fuse element, is of the ribbon type for larger surface area, and yet is enclosed in a casing of convenient length.

Accordingly, it is a general object of this invention to provide an improved current limiting fuse which has a helically formed fuse element made from ribbon-like fuse element material wherein the fuse element is capable of being contained in a casing of convenient length.

It is another object of this invention to provide an improved high voltage, current limiting fuse having a helically formed fuse element of ribbon-like fuse material where the ribbon is on edge with respect to the axis of the helix.

SUMMARY OF THE INVENTION

The fuse, according to one form of the present invention, has a helix of ribbon fuse element material formed with the ribbon oriented on edge with respect to the axis of the helix, which is conveniently also the central axis of the casing, rather than with a flat surface towards the central axis. This arrangement requires less axial distance for the same number of turns.

In accordance with one form of the invention, there is provided a fuse comprising a tubular casing of insulating material with terminal means at each end of the casing, closing the casing. A ribbon-like fuse element is disposed in a helical configuration within the casing and extends from one terminal means to the other with the fuse element being edge-on with respect to the axis of the helix. Arc quenching material is disposed in the casing surrounding the fuse element.

In forming a helix of a ribbon fuse element where the ribbon is on edge with regard to the axis of the helix, it is convenient to form ripples or indentations in the ribbon on the side thereof nearer the axis of the helix. Preferably, the ripples have a maximum extent or maximum displacement on the edge nearer the axis with the ripples decreasing in extent or displacement towards the edge farther from the axis.

In accordance with another form of the invention, there is provided a high voltage current limiting fuse comprising a tubular casing of insulating material having a central axis, a first and a second metallic end cap each secured to and closing a respective end of the casing, a ribbon-like fuse element formed in a helical configuration, the helix thereof having an axis substantially coincident with the central axis and extending from the first end cap to the second end cap, the fuse element being oriented substantially on edge with respect to the central axis, the fuse element having ripples formed therein extending generally across the ribbon-like element, the ripples having a maximum displacement at the edge of the fuse element nearer the central axis and a decreasing displacement towards the edge farther from the central axis, and pulverulent arc quenching material within the casing surrounding the fuse element.

BRIEF DESCRIPTION OF THE DRAWINGS

My invention will be more fully understood and its several objects and advantages further appreciated by referring now to the following description, taken in conjunction with the accompanying drawings, wherein:

FIG. 6 is a general isometric view of portions of the fuse element of FIG. 3.

DETAILED DESCRIPTION OF THE INVENTION

Figure 1:
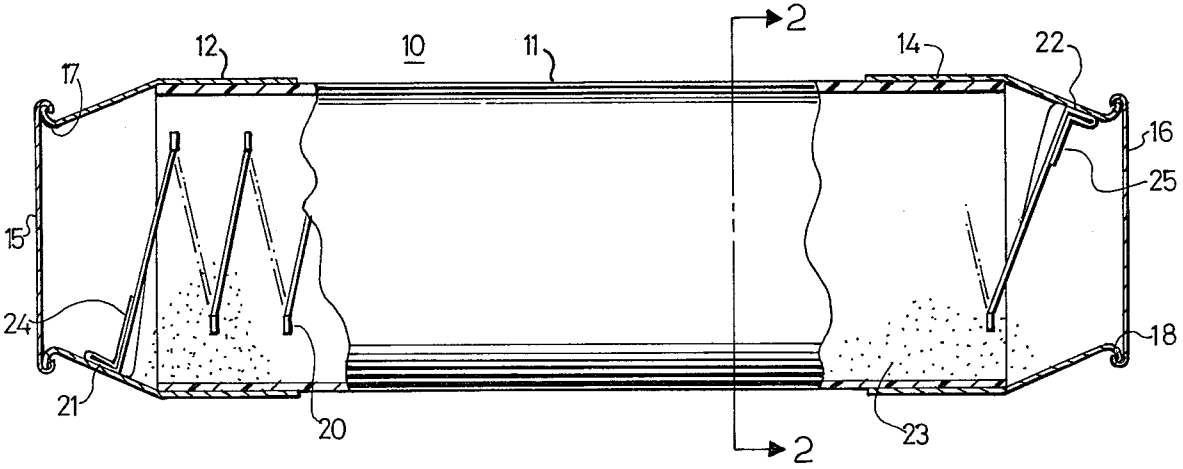
FIG. 1 is an elevation, partly in cross-section, of a current limiting fuse according to one embodiment of the invention.

Referring now to FIG. 1, there is shown a partial longitudinal sectional view of a current limiting fuse 10 having a hollow cylindrical or tubular casing 11 of insulating material, such as for example fiberglass and epoxy resin, with a terminal cap or end cap 12 at one end and a terminal cap or end cap 14 at the other end. The end caps 12 and 14 are of a conductive metal and are mounted to the casing 11 by means of a tight press fit. A sealant is used to ensure the casing is waterproof. The end caps 12 and 14 include closure discs 15 and 16 respectively. The discs 15 and 16 are pressed or crimped around lips 17 and 18 of caps 12 and 14 respectively, as indicated in FIG. 1, to close the ends. A ribbon-like fuse element 20 is in a helical configuration, one end of which is welded, brazed or otherwise conductively secured to end cap 12 at 21 and the other end of which is welded, brazed or otherwise conductively secured to end cap 14 at 22. The fuse element 20 is oriented on edge with respect to the central axis of casing 11. The casing 11 is filled with a pulverulent arc quenching material 23, such as for example, quartz sand, silica or other suitable materials, as are well known in the art.

In the embodiment of FIG. 1, there is no central supporting core of insulating material such as a ceramic material. That is, the fuse element is "free standing". The fuse element 20 is, of course, supported by the arc quenching material 23 when the fuse is assembled. It is preferred to have a fuse with a free standing fuse element because the expense of a core and core mounting means is eliminated and because it is possible a core might interfere at least to some degree with the contact between the fuse element and the arc quenching material. However, the use of a core might, in some circumstances, make assembly easier and the invention contemplates both forms of fuse. It will, of course, be apparent that the end caps 12 and 14 of fuse 10 would require change or modification to adapt the fuse to include a core.

The assembly of the fuse of FIG. 1 is quite straight forward. The terminal caps or end caps 12 and 14 (without closure discs 15 and 16) are mounted to casing 11. A sealant is placed around each end of casing 11 and end caps 12 and 14 are pressed over the respective ends of casing 11. A helical coil is made of a fusible ribbon-like material, such as silver, copper, aluminum or zinc. The ribbon-like material has a thickness suitable for the desired fuse characteristics and the width and type of fusible material used. For example, fuse elements have been used with a width of 0.274 inches and a thickness typically in the range of 0.002 to 0.009 inches, but this range may readily be exceeded for different fuse element materials and different desired characteristics. The selection of appropriate material and the ribbon size is within the capability of those skilled in the art.

The helix is formed with the ribbon substantially on edge with respect to the axis of the helix. This is unlike prior art current limiting fuses. The helical coil or helix should have a certain degree of stiffness and also springiness or resilience, particularly when no supporting core is used. The ends of fuse element 20 are doubled back to form terminal portions 24 and 25. These terminal portions 24 and 25 may be, for example, formed by doubling back a length of perhaps two inches and soldering the doubled back portion to the adjacent length of fuse element. The purpose of doubling back a length of fuse element is to provide a terminal portion of increased cross-section. The portion of increased cross-section may, of course, be formed in any manner and doubling back a length and soldering it is a convenient manner with which to provide a terminal portion of twice the cross-sectional area of the ribbon. The increased cross-section prevents or at least delays any melting or rupturing under fault conditions in the terminal portions 24 and 25 where the possibility exists of an arc forming between the terminal portion and adjacent end cap.

When the helical coil is completed, the terminal portion 24 is spot welded to the end cap 12 at a point 21 located beyond the end of casing 11 as seen in FIG. 1. The closure disc 15, which has a flat portion and an upturned rim is placed over end cap 12 with the rim extending past lip 17 on the end cap 12. The rim is then crimped or formed over lip 17 to close the end cap 12.

Figure 2:
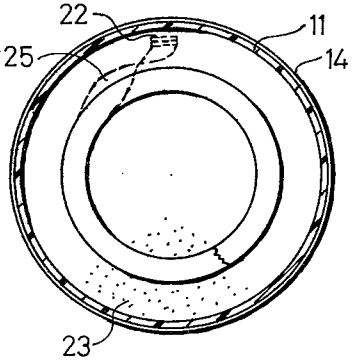
FIG. 2 is a sectional view taken along line 2—2 of FIG. 1.

The casing 11 is then placed in an upright position with end cap 12 as the bottom. Using a suitable tool, fuse element 20 is grasped by terminal portion 25 and the helix is expanded and positioned with terminal portion 25 extending towards and terminating adjacent end cap 14 ready to be welded to end cap 14. Then, in a preferred form, a spout is inserted downwardly through end cap 14 and pulverulent arc quenching material 23 is carefully introduced, making sure that the helix is positioned centrally inside casing 11. It has been found to be desirable to introduce the arc quenching material at the center of the helix and to add it slowly to avoid displacing the helix to the side and to keep the spacing between turns generally the same. Small irregularities or differences in the helix are quite acceptable and do not appear to degrade the operation of the fuse, but large irregularities should be avoided. Arc quenching material 23 is added until the level is below the end of casing 14. Then, terminal portion 25 is spot welded to end cap 14 at 22. More arc quenching material is then added until the fuse is full. The fuse 10 is preferably vibrated to compact the arc quenching material. More material is added, if necessary, and closure disc 16 is positioned and the rim thereof crimped over lip 18 of end cap 14, as seen in FIGS. 1 and 2. The terminal portion 25 of fuse element 20 may, of course, be welded to the end cap 14 before adding any arc quenching material, but the welding operation is perhaps easier when the major part of the fuse element is supported by the pulverulent arc quenching material.

The fuse element 20 of fuse 10 is flat or unrippled. It can, for example, be a straight ribbon of fusible material which is passed through a tool to stretch the material unevenly across its width. This will form the straight ribbon into a helix, suitable for use in a fuse according to the invention. However, forming a helix in this manner stretches the material towards the outer edge, alters the cross-section of the fuse element, and consequently may affect the characteristics of the fuse. Therefore this flat or unrippled fuse element 20 is not preferred. A preferred form of fuse element for fuse 10 is a rippled fuse element as will subsequently be described in connection with FIGS. 3–6.

Figure 3:
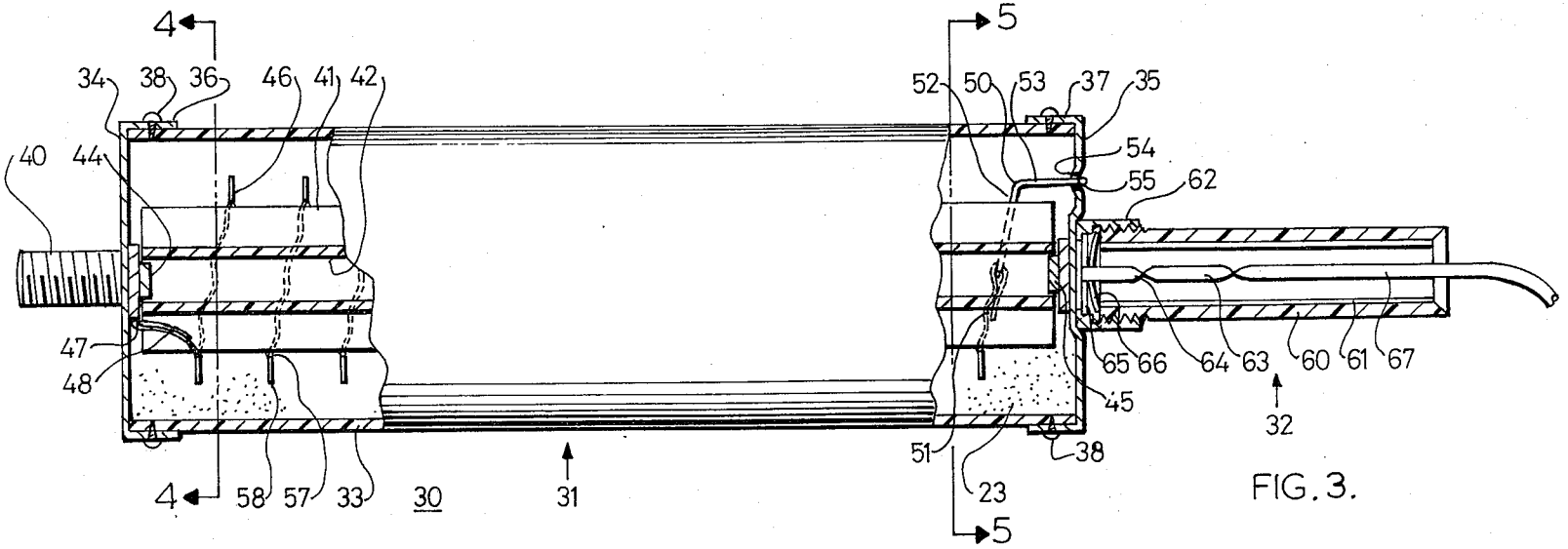
FIG. 3 is an elevation, partly in cross-section, of a current limiting fuse according to another embodiment of the invention.
Figure 5:
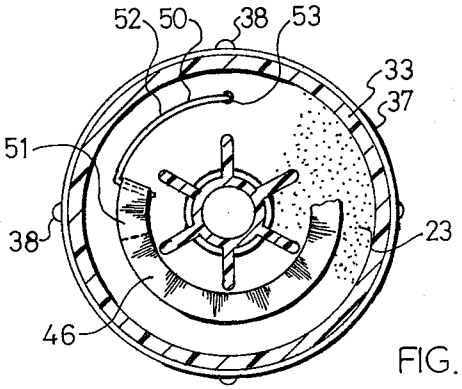
FIGS. 4 and 5 are sectional views taken along lines 4—4 and 5—5 respectively of FIG. 3.
Figure 4:
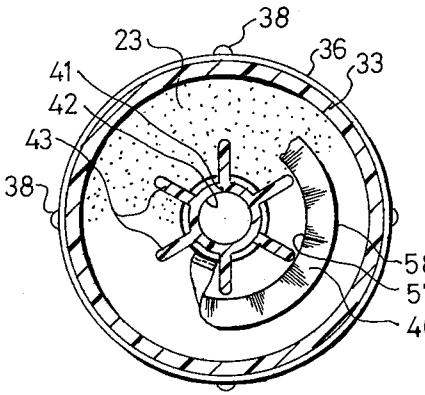

Referring now to FIG. 3, there is shown a partial longitudinal sectional view of a combination fuse 30 having a current limiting section 31 and an expulsion section 32. It is the current limiting section 31 with which this invention is concerned. The current limiting section 31 is, in fact, a current limiting fuse which is placed in series with an expulsion fuse to form a combination fuse. The current limiting section 31 is shown as having a central supporting core to illustrate an alternative form, but in a preferred form this core is omitted.

Referring to FIGS. 3, 4, 5 and 6 the current limiting section 31 or current limiting fuse 31 has a hollow cylindrical or tubular casing 33 made of insulating material, such as for example fiberglass and epoxy resin. Casing 33 may be the same as casing 11 of FIG. 1. A metal end cap 34 closes one end of casing 33 and a metal end cap 35 closes the other end. The end caps 34 and 35 have rims 36 and 37 respectively which are made to be a close fit with the outside surface of casing 33. The end caps 34 and 35 are each secured to casing 33 by several self threading, self tapping screws 38. A threaded mounting stud 40 is fastened to end cap 34 and projects therefrom for mounting the fuse to a bracket or bus bar (not shown).

A central supporting core 41, of ceramic or similar insulating material, has a central bore 42 and projecting ribs or flanges 43 extending the length of core 41. On the inside of end caps 34 and 35 are projections 44 and 45 respectively which extend into bore 42 at each end of core 41 to mount it centrally within casing 33. A ribbon-like fuse element 46, perhaps best seen in FIG. 6, is formed into a spiral or helix with the width of the ribbon-like material extending in a direction substantially at right angles to the axis of the helix, that is edge-on to the axis of the helix, and is connected at 47 to end cap 34 by soldering. The terminal portion 48 of fuse element 46 comprises a portion of increased cross-section conveniently formed by doubling back one tip or end of the helix and soldering the doubled back portion to itself. It is the terminal portion 48 that is soldered to end cap 34 and it extends away from end cap 34 providing a length of increased cross-section to reduce or prevent any arcing tendency with the end cap 34. The other end of the helix is folded back over a wire 50 and soldered to itself as well as to the end of the wire 50. The doubled portion 51 may, for example, be of the order of one inch in length. The wire 50 is preferably of equal or greater cross-sectional area than the cross-sectional area of the doubled fuse element. The wire 50 has a curved part 52 which generally follows the path of the helix and a straight part 53 which extends in a direction parallel to the axis of casing 33 and projects through a hole 54 in end cap 35 where it is bent flush to the outer surface of cap 35 and soldered at 55. The general configuration of wire 50 can be seen in FIGS. 5 and 6. A pulverulent arc quenching material 23 fills casing 33. The ribbon-like material of fuse element 46 is preferably rippled or corrugated with the ripples extending generally radially, in relation to the helix axis, across the fuse element. In a preferred form, the ripples 56 have a maximum displacement at the edge 57 of the fuse element 46 which is nearer the axis of the helix and a decreasing displacement towards the edge 58 of the fuse element farther from the axis of the helix. The ripples may possibly tend to increase the surface area slightly and also impart a certain degree of stiffness or rigidity to the material, which may be desirable. The rippled form of fuse element shown as fuse element 46 is preferred. It is also preferred for fuse 10 of FIG. 1 (as was previously mentioned) as well as for fuse 30 of FIGS. 3–5. The cross-section of the material is substantially unaffected by the rippling and the rippling tends to increase the rigidity which is particularly desirable for fuse elements that are free standing.

It is convenient to form straight (i.e., not yet curved into a helical form) flat ribbon-like fuse material into helical form by running it through a tool having a pair of meshing toothed rotatable wheels with the teeth formed to cooperate in crimping or indenting the ribbon-like material as it is passed between the teeth. The teeth can be arranged to form a maximum displacement of crimp towards one edge of the material and this will tend to form the material into a helix. The tips or ends of the rippled fuse element may be flattened where they are doubled back to form a terminal portion, but this flattening is not necessary.

Referring to FIG. 3, the expulsion section 32 is of a type well known in the art and comprises an expulsion tube 60 which preferably has a coating 61 on its inner surface to help in cooling and extinguishing the arc formed when the fuse link 63 blows. The expulsion tube 60 is threaded at one end and is screwed into an internally threaded end mount 62. End mount 62 is welded to, or otherwise secured to, end cap 35. A fuse link 63 is connected to a coupling unit 64 having a disc-like end portion 65. A washer 66 is secured within end mount 62 by the inner end of expulsion tube 60 when the tube 60 is screwed into the end mount 62 and the washer 66 engages end portion 65 retaining it in place and providing good electrical contact with end cap 35. The other end of fuse link 63 is connected to a flexible cable 67 which extends within tube 60 and outwardly through the open end thereof. Cable 67 is connected to a spring arrangement (not shown) which keeps it under tension. The structure and operation of such expulsion tubes is well known in the art.

The assembly of the fuse of FIG. 3 will now be described. An adhesive is applied to an end of a core 41 and core 41 is positioned on projection 44 of end cap 34. After the adhesive is set, the fuse element 46, which has been prepared in helical form is placed over core 41. The fuse element 46 in its helical form has a central passage just slightly larger than the periphery of core 41 as defined by the tips of ribs or flanges 43 so that the fuse element 46 will slip over the core 41 and will be supported against radial movement by core 41. The terminal portion 48 of fuse element 46 is then soldered to the end cap 34 at 47. A sealant is applied to an end of casing 33 which is pressed into rim 36 of end cap 34. The rim 36 and casing 33 are, of course, made so that there is a close fit. The end cap 34 is then secured to casing 33 with self tapping, self threading screws 38.

The casing 33 is then placed in a vertical or upright position with end cap 34 as the bottom. The coiled fuse element 46, which it will be recalled, is springy or resilient, extends only part way up on the inside of casing 33. The upwardly extending wire 50 at the end of the coiled fuse element 46 is gripped by pliers or some similar tool and is drawn upwards until a portion of the straight part 53 of wire 50 projects beyond the end of casing 33 where it is retained while the casing is filled. A spout (not shown) is positioned over casing 33 and a pulverulent arc quenching material 23, (for example, quartz sand with additives if desired), is discharged into casing 33. The arc quenching material 23 is added slowly so as not to alter the generally even spacing between turns of the fuse element 46. Casing 33 may be vibrated to settle and consolidate the arc quenching material as is known. Sufficient material 23 is introduced to ensure there will be no unoccupied space around the fuse element when end cap 35 is applied.

End cap 35 is rotated until hole 54 is aligned with straight part 53 of wire 50. The hole 54 is the same radial distance from the central axis of the end cap 35 as is straight portion 53 from the axis of the helically coiled fuse element 45. A sealant is applied around the end of casing 33 and the rim 37 of end cap 35 is placed over the end of casing 33. The rim 36 is made to be a close fit with casing 33. Self tapping, self threading screws 38 are then screwed through rim 37 into casing 33 to secure the end cap 35.

The portion of the straight part 53 of wire 50 which projects through hole 54 is bent flat against the outer surface of end cap 35 and soldered or otherwise conductively bonded at 55 to end cap 35. The soldering material also conveniently serves to seal opening 54. It may be more convenient to withdraw the wire 50 and attached coil slightly farther before filling the casing 33 with arc quenching material 23 and mounting end cap 35, so that the straight portion 53 of wire 50 can be bent at right angles to be parallel to and slightly spaced from the surface of end cap 35. The wire 50 can then be pushed back through hole 54 until the bent part abuts the surface of the end cap and soldered thereto.

It is convenient to provide a shallow depression or dished portion adjacent hole 54 in end cap 35 to receive the bent tip of the straight portion 53 of wire 50. The tip can then be soldered in the dished portion leaving the exterior of end cap 35 substantially flat in the region of hole 54.

To complete the assembly of fuse 30, the disc-like end portion 65 of the fuse link with overlying washer 66 are positioned within end mount 62 with the fuse link 63 and cable 67 extending into expulsion tube 60. Tube 60 is then screwed into end mount 62. The assembled fuse provides a series arrangement from end cap 34 through fuse element 46, wire 50, end cap 35, fuse link 63 and cable 67.

It was previously mentioned that a preferred form of the invention omitted core 41 from the fuse of FIG. 3 so that the fuse element 46 would be free standing. The assembly of such a fuse would be similar to that given above, except that there would be no mounting of core 41. When the pulverulent arc quenching material is added to such a fuse, care should be taken to maintain the helically coiled fuse element 46 is centered within casing 33 prior to the introduction of the arc quenching material, and the material should be added slowly and preferably centrally to keep radial displacement of fuse element 46 to a minimum.

The manner in which current limiting fuses operate is believed to be well known in the art and a description of the operation is thought to be unnecessary.

While I have illustrated preferred embodiments of my invention, many modifications will occur to those skilled in the art and I therefore wish to have it understood that I intend in the appended claims to cover all such modifications as fall within the true spirit and scope of my invention.

What I claim as new and desire to secure by Letters Patent of the United States is:

1. A high voltage, current limiting fuse comprising;

a tubular casing of insulating material having a central axis;

a first and a second metallic end cap each secured to and closing a respective end of said casing;

a ribbon-like fuse element formed in a helical configuration, the helix thereof having an axis substantially coincident with said central axis and extending from said first end cap to said second end cap, said fuse element being oriented substantially on edge with respect to said central axis, said fuse element being free standing, said fuse element has ripples formed therein extending generally across the ribbon-like fuse element, said ripples having a maximum displacement at the edge of said fuse element nearer said central axis and a decreasing displacement towards the edge of said fuse element further from said central axis and;

pulverulent arc quenching material within said casing surrounding said fuse element.

2. A high voltage, current limiting fuse as defined in claim 5 in which a portion at each end of said fuse element is doubled back on itself to form a terminal region.

3. A fuse element for a high voltage, current limiting fuse comprising;

a ribbon-like element of fusible material formed in a helical configuration with said ribbon-like element being oriented substantially on edge with respect to the axis of the helix, said fuse element being free standing, said fuse element has ripples formed therein extending transversely of said element and spaced in a lengthwise direction therealong, said ripples having a maximum displacement on the edge of said element nearer the axis of said helical configuration and decreasing in displacement towards the edge of said element farther from said axis.

4. A fuse element as defined in claim 1 or 3 in which the cross section of said fuse element is substantially unaffected by said ripples.

* * * * *